United States Patent [19]

Rodrigo

[11] Patent Number: 4,860,159

[45] Date of Patent: Aug. 22, 1989

[54] TAPE DISPENSER WITH STATIC NEUTRALIZER

[75] Inventor: Richard D. Rodrigo, Line Lexington, Pa.

[73] Assignee: The Simco Company, Inc., Hatfield, Pa.

[21] Appl. No.: 243,488

[22] Filed: Sep. 12, 1988

[51] Int. Cl.[4] ..... H05F 3/02

[52] U.S. Cl. ..... 361/212; 361/221; 242/55; 242/55.2

[58] Field of Search ..... 361/212, 213, 214, 220, 361/221; 242/55, 55.2

[56] References Cited

U.S. PATENT DOCUMENTS

| | | | |
|---|---|---|---|
| 2,264,683 | 12/1941 | Smith | 361/213 X |
| 3,128,492 | 4/1964 | Hanscom et al. | 352/130 X |
| 3,396,917 | 8/1968 | Carter | 361/213 X |
| 3,636,408 | 1/1972 | Shuman | 361/221 X |
| 4,336,535 | 6/1982 | Albertine, Jr. | 340/779 X |
| 4,352,143 | 9/1982 | Uno | 361/221 |
| 4,553,191 | 11/1985 | Franks, Jr. et al. | 361/213 X |

*Primary Examiner*—E. T. Hix
*Assistant Examiner*—Brian W. Brown
*Attorney, Agent, or Firm*—Stanley Bilker

[57] ABSTRACT

Static neutralizer for a tape dispenser in which a roll of tape is rotatably supported for drawing off selected lengths in strips comprises first brush means in juxtaposition with a surface of a tape portion radially peeled from the roll, second brush means in juxtaposition with an outer surface of the tape which has just been bared by the tape portion previously peeled from the roll, and a conductive path electrically interconnecting the first and second brush means, whereby any charges developed on the peeled-away portions of the tape are neutralized prior to dispensing. The respective brush means may be made of carbon or stainless steel fibers whose ends can be adjacently spaced from the corresponding charged surface thereby acting as an induction ionizer with respect thereto or in actual contact with such surfaces and defining a passive static eliminator.

16 Claims, 1 Drawing Sheet

FIG. 1
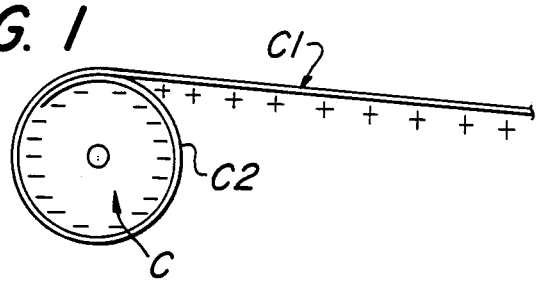
FIG. 2
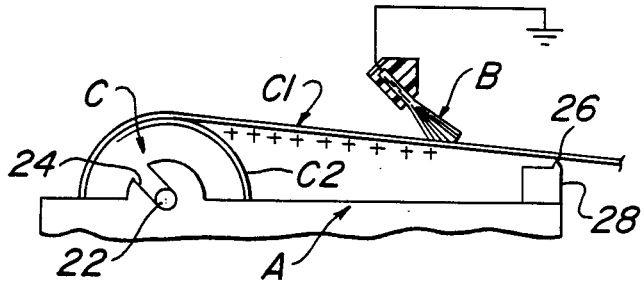
FIG. 3
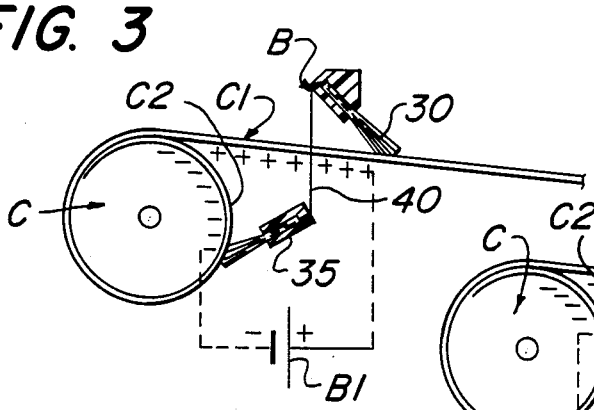
FIG. 3A
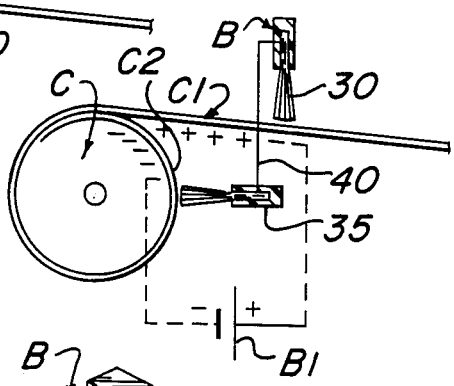
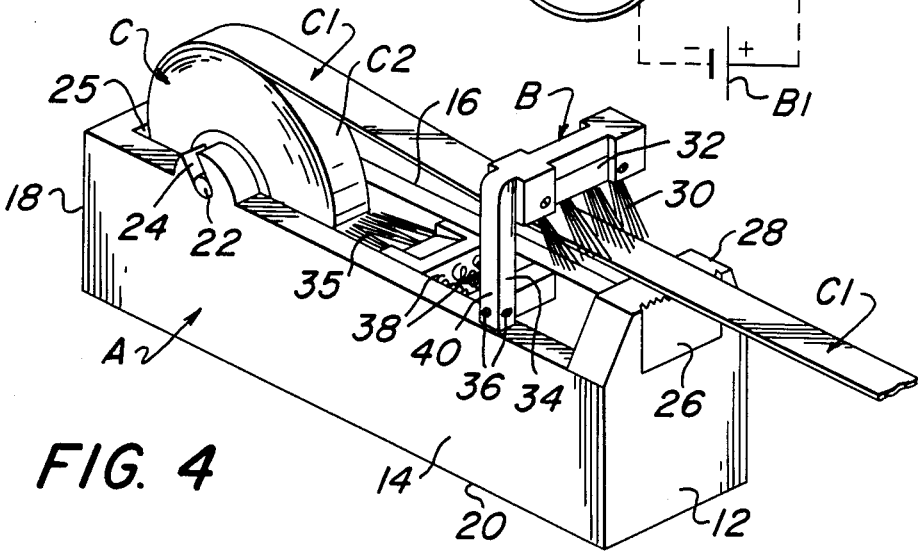
FIG. 4

TAPE DISPENSER WITH STATIC NEUTRALIZER

BACKGROUND OF THE INVENTION

1. Field of the Invention

This invention relates to static neutralizers for roll-type dispensers of pressure-sensitive and adhesive tape prior to application thereof in strip form of selective lengths to the intended article or parts. More particularly, this invention concerns an induction or passive static discharging means for dispensers delivering adhesive as well as non-adhesive backed tapes and film.

When thin film plastic tapes, including cellophane, polyesters, polyethylene, polypropylene, vinyls and the like are radially peeled from an underlying roll on which they are coiled, preparatory to adhesive placement in strip form upon an article surface or in a second smaller coil wrapped about an object, a static charge is triboelectrically developed on the free end of the tape as a consequence of the separation of the two surfaces previously in intimate contact with each other. This results in one of the surfaces (on a tape section now peeled away but theretofore in abutment) assuming a charge of one polarity while the other surface (on a tape portion still coiled but just bared by the stripped away-section) becomes charged to the opposite polarity.

This problem is especially exaggerated in the case of very thin film polyester pressure sensitive tape (for example, "Mylar", a product of E. I. DuPont de Nemours), where thickness is one mil or less, when it is almost impossible to manipulate statically charged strips being dispensed. Such tape becomes so highly charged to the extent that sections are incontrollably attracted to or repelled from adjacent bodies and are characterized by a tendency to stick to themselves, to the roll from which they were recently attached and/or to cling to the user's hands. Since strips of these tapes are dispensed from rolls as a matter of course in the electrical industry, for example in wrapping components, in offices, by artists and decorators, as well as by the general public, it is apparent static charge conditions in regard to tape dispensers are quite significant.

Elimination of static electricity during manufacture of the tape or upon formation of the tape into rolled-up coils does not alleviate the problem because during dispensation from the roll, the triboelectric or frictional peeling effect produces a reecharging of the tape's drawn off free end, the charge being opposite in polarity to that on the outer coil surface from which the separated portion was drawn. The manifestation of the charging indicia is set forth in FIG. 1.

2. Prior art

In U.S. Pat. No. 3,636,408, there is shown a tape dispenser in combination with a static neutralizer in which a free end of the tape is drawn past a plurality of electrical conductors, such as brushes, transversely disposed across one or both sides thereof and connected to electrical ground. An example of this prior art system is shown in FIG. 2. If a grounding mechanism were not used in this patented system, the brushes would "float" and charge up themselves, thus defining a capacitance preventing further current flow.

U.S. Pat. No. 2,264,683 employs a radioactive substance in the dispenser adjacent the free end of the tape to effect neutralization of the static charges by means of alpha rays. The disadvantage of this approach is the limited life of the radioactive substance in addition to the restrictions imposed by the NRC upon radioactive materials, the latter preventing the usage of such dispensers by the general public.

U.S. Pat. No. 3,128,492 shows a device for neutralizing film by impinging ions of both polarities upon one or both surfaces by means of high voltage static eliminators located within the housing and coupled to a power cord for insertion in a line receptacle. Still another type of neutralizer presently marketed employs a high voltage air ionizer mounted within the base of the tape dispenser wherein two emitters, one of each polarity, directs air ions generated by corona discharge against the film. The problems associated with each of these latter approaches are the large dispenser size to accommodate a power supply, the need to plug into a line power outlet, the proximity of high voltage and very high relative cost.

SUMMARY OF THE INVENTION

It is therefore an object of this invention to provide a static neutralizer for film or tape dispensers which will passively discharge tapes drawn from coiled rolls thereof so as to permit easy handling preparatory to and during application of selective lengths of such tapes upon intended articles.

Another object of this invention is to provide a static neutralizer for film or tape dispensers which are adapted to be entirely self-contained without requiring a connection to a line voltage source, or to high voltage, or to ground or to a radioactive device.

Still another object of this invention is to provide a film or tape dispenser which is altogether safe to use.

Other objects of this invention are to provide an improved device of the character described which is easily and economically produced, sturdy in construction, and both highly efficient and effective in operation.

According to the present invention, the static neutralizing tape dispenser includes first conductive brush means transversely disposed across a surface of the tape and in juxtaposition with a portion thereof radially peeled from a roll rotatably supported in the dispenser, and a second conductive brush means in transverse juxtaposition with an exposed outer surface of the roll which has just been bared by the tape portion previously peeled, the first and second brush means beins electrically interconnected to each other by a conductive path. In this manner, any charge developed on the uncoiled free end of the tape as it is separated from the roll becomes neutralized by the opposite charge generated on the outer surface of the coil from which the free end was detached. The first and second brush means may comprise sharp-pointed fine conductive elements, such as stainless steel or carbon fibers, whose ends are adjacently spaced from the corresponding propinquent surface (acting in a manner similar to induction ionizers), or in the form of wiper elements which actually contact the adjacent tape surface (preferrably the outer or nonadhesive face) to define a passive static eliminator.

BRIEF DESCRIPTION OF THE FIGURES

With the above and related objects in view, this invention consists of the details of construction and combination of parts as will be more fully understood from the following detailed description when read in conjunction with the accompanying drawing in which:

FIG. 1 is a schematic representation of the charging phenomenon produced by detachably peeling-away the free end of a coil of tape.

FIG. 2 is a schematic representation of the equivalent circuit of a prior art static neutralizing device for tape dispensers.

FIG. 3 is a schematic representation and equivalent circuit for a tape dispensing static neutralizer employing brush discharging means embodied in the present invention wherein the brush discharging means are in contact with the tape portions to be neutralized.

FIG. 3A is a schematic representation and equivalent circuit for a tape dispensing static neutralizer embodying this invention wherein the brush discharging means are adjacently spaced from the surface of the tape portions to be neutralized.

FIG. 4 is a perspective view of a tape dispenser embodying the static neutralizer of the present invention.

DETAILED DESCRIPTION

Referring now in greater detail to the drawings in which similar reference characters refer to similar parts, there is shown a tape dispenser, generally designated as A, in combination with a static neutralizer B of the present invention.

The tape dispenser may be of any suitable size and form, including industrial type units handling tape rolls, for example 4 inches or more in diameter, or narrow ½ inch strips of cellophane or polyethylene tapes intended for general public use. As shown in FIG. 4, the dispenser A is conventionally boxshaped in configuration comprised of four enclosing walls 12, 14, 16 and 18 upstanding from a closed bottom 20, as desired. A tape roll C having a spindle 22 is horizontally mounted within the dispenser A and is also freely rotatable in notches 24 formed in the side walls 14 and 16. The notches 24 are suitably spaced from the bottom so that a complete coil C can be retained within channel 25 defined by said side walls. In a standard manner, a selected length or strip C1 of tape is radially peeled from the upper portion of the coil C and drawn over a cutting edge 26 mounted on a ledge 28 upstanding from end wall 12.

The tape may be of the pressure-sensitive type or of any type commony formed in a coil, such as dry tape which is adapted to be fed from a dispenser. Typically, and as shown in FIG. 1, one of the surfaces of the peeled apart end C1 assumes a charge of one polarity, for example—positive, while the outer surface C2 of the tape still remaining on the coil C from which end C1 is stripped becomes charged to the opposite polarity, for example—negative.

The static neutralizers B are of the passive discharging or induction ionizing type wherein they are juxtaposed with a charged surface to be neutralized and the charge on that surface is discharged or dissipated as a result of the potential difference between the charged surface and the adjacent end of the neutralizer. That is, by positioning a passive or induction static neutralizer next to a charged surface (either touching or adjacently spaced from such charged surface, these charges are drawn off so that the surface becomes effectively neutralized.

As shown in FIG. 4, a conductive brush element 30 is transversely disposed across the free end C1 of the tape and traverses across the upper face thereof during dispensing. At the same time, a second brush element 35 moves across the outside coil surface C2 during unwinding thereof. The conductive brushes 30 and 35 may be stainless steel or carbon fiber brushes, such as those shown and described in U.S. Pat. Nos. 4,336,535, 4,352,143 or 4,553,191. If the ends of these brushes 30 or 354 actually touch the tape C itself, they preferrably contact a nonadhesive-carrying surface, wherever possible, as shown in FIG. 3. However, the brushes 30 and 35 may just as well be adjacently spaced from corresponding tape portion C1 or C2, as shown in FIG. 3A. In either case, the brushes 30 and 35 are not connected to ground but are interconnected through a conductive path 40, which in practice is defined by the mounts and brackets supporting these elements upon the dispenser.

In FIG. 4, the brush elements 30 are suspended in suitable clamps from a conductive arm 32 bridging across the dispenser channel 25 by way of bracket 34. The bracket 34 is also conductive and is attached to side wall 14 by mounting screws 36. A conductive crosspiece 38 forming the lower portion of the bracket 34 extends across the upper portion of the side walls 14 and 16 above the channel 25. The brushes 35 are suitably clamped in the end of the crosspiece 38 which faces the tape roll C and are adapted to project within the channel 25 into contiguous disposition with the face C2 of the roll C previously underlying the peeled-away end C1 thereof. The conductive path 40 between the upper set of brushes 30 and the roll juxtaposed brushes 35 is defined by the arm 32, the bracket 34 and the crosspiece 38, all of which may be fabricated of a suitable metal, such as aluminum. In the alternative, the bracketry supporting both sets of brushes 30 and 35 may be molded of a suitable plastic composition, in which event, because of the insulative characteristic of plastic components, a conductive wire 40 internally or externally threaded in a conventional manner from one set of brushes to the other would define the conductive path interconnecting said brushes.

Referring now to FIG. 3, an equivalent circuit diagram is demonstrated for the present invention wherein, by way of illustration, positive charges are developed on the free end C1 of the tape during its peeling from the roll C while negative charges are correspondingly generated on the outer surface C2 recently exposed by pulling off end C1. However, it is to be noted that these polarities may be reversed depending upon the nature of the plastic composition of the tape and the kind of adhesive employed. When the two sets of brushes 30 and 35 are interconnected electrically, the circuit is closed for draining off charges. The two surfaces C1 and C2 in contact with the respective brushes 30 and 35 in effect define the positive and negative terminals of an "imaginary" battery B1, the circuit being completed by the actual conductive path 40 interconnecting the two sets of brushes. In FIG. 3A, the brushes 30 and 35 always remain adjacently spaced from the respective tape portions C1 and C2 and never touch the contiguous surfaces.

When static charges are generated during uncoiling of the tape, the "battery" B1 becomes charged, thereby driving current flow between the brushes 30 and 35 so as to effect neutralization of the tape portion C1. With this procedure, neither the brush 30 nor the brush 35 requires grounding, thus making the passive static discharging invention most convenient and inexpensive.

It is also to be noted that since both surfaces of the tape portion C1 becomes charged as a result of charge migration, brush 30 can be juxtaposed with the upper or lower surface of coil portion C1, as desired.

Although this invention has been described in considerable detail, such description is intended as being illustrative rather than limiting, since the invention may be variously embodied, and the scope of the invention is to be determined as claimed.

I claim:

1. In combination with a tape dispenser in which a coil of tape is rotatably supported for uncoiling thereof to deliver selected lengths in strips therefrom, a static electricity neutralizer comprising:

(a) first passive discharging means in juxtaposition with a portion of the tape radially peeled from the roll, (b) second passive discharging means in juxtaposition with an uncoiled outer surface of the tape just exposed by the portion previously peeled from the roll, and (c) conductive means interconnecting said first and second passive discharging means to define independent of any external ground a conductive path for neutralizing any charges developed on the peeled away portion as a result of separation of abutting surfaces whereby neutralization will be effected without any external ground connection, or line voltage source or high voltage power source.

2. The tape dispenser of claim 1 wherein said first passive discharging means is in contact with the tape portion peeled from the roll.

3. The tape dispenser of claim 2 wherein said first passive discharging means abuts against the outer radial surface of the peeled tape portion.

4. The tape dispenser of claim 1 wherein said first and second passive discharging means abut against the respective juxtaposed surfaces.

5. The tape dispenser of claim 1 wherein each of said passive discharging means comprise a brush having conductive bristles.

6. The tape dispenser of claim 5 wherein said bristles are pointed fibers selected from the group consisting of stainless steel and carbon.

7. The tape dispenser of claim 5 wherein said bristles have pointed ends adjacently spaced from the juxtaposed surfaces thereof.

8. The tape dispenser of claim 5 wherein said first and second brushes are mounted in a conductive frame on said dispenser interconnecting said brushes.

9. In a tape dispenser for rotatably supporting a roll of tape delivering selective lengths of strips therefrom, static discharging apparatus comprising a first conductive brush transversely disposed with respect to a surface of a portion of tape radially peeled away from a roll, a second conductive brush transversely juxtaposed with respect to a coiled surface of tape just exposed by the peeled away portion, and means for electrically interconnecting the first and second brushes in a closed conductive path independent of any external ground connection.

10. The tape dispenser of claim 9 wherein said first brush is in contact with one surface of the peeled-away tape portion.

11. The tape dispenser of claim 9 wherein said second brush is in contact with the adjacently juxtaposed coiled surface.

12. The tape dispenser of claim 9 wehrein said first and second brushes are adjacently spaced from the respective juxtaposed surfaces thereof.

13. A method for electrically discharging tape dispensed from a roll comprising the steps of: juxtaposing with a first passive electrostatic eliminator a surface of a portion of tape just peeled from the roll, simultaneously juxtaposing with a second passive static eliminator an outer coiled surface of the tape just exposed by the peeled away portion, and electrically interconnecting the first and second passive static eliminators through a conductive path without coupling any portion of the tape, or the first or second passive static eliminators to an external ground connection.

14. The method of claim 13 wherein the juxtaposing steps are performed prior to separation of the peeled away portion from the next longitudinally adjacent tape section.

15. The method of claim 13 wherein the juxtaposing steps comprise adjacently spacing the first and second passive electrostatic eliminators from their next propinquent surfaces.

16. The method of claim 13 wherein the juxtaposing steps are performed with conductive brushes.

* * * * *